United States Patent [19]

Hulshizer

[11] 4,001,527

[45] Jan. 4, 1977

[54] ELECTRICAL TIMER-SWITCH

[76] Inventor: Stephen Joseph Hulshizer, 14 Cedar Hill Road, Hatfield, Pa. 19440

[22] Filed: June 13, 1975

[21] Appl. No.: 586,732

Related U.S. Application Data

[60] Continuation-in-part of Ser. No. 475,741, June 3, 1974, abandoned, which is a division of Ser. No. 337,831, March 5, 1973, Pat. No. 3,828,224.

[52] U.S. Cl. ..... 200/38 FB; 200/33 R; 200/38 D; 200/51 R; 174/53

[51] Int. Cl.[2] ..... H01H 43/00; H01H 9/00

[58] Field of Search ..... 200/38 R, 38 FA, 38 FB, 200/38 D, 51 R, 33 R; 174/53; 307/114, 147

[56] References Cited

UNITED STATES PATENTS

| | | | |
|---|---|---|---|
| 2,085,624 | 6/1937 | Allen | 200/38 FB |
| 2,477,862 | 8/1949 | Cook | 307/114 |
| 2,938,976 | 5/1960 | Wilson | 200/51 R |
| 3,548,125 | 12/1970 | Banathy | 200/38 D |
| 3,582,581 | 6/1971 | Hawks | 200/38 FB |
| 3,728,500 | 4/1973 | Ingram | 200/38 FB |
| 3,889,132 | 6/1975 | Vreeland | 200/33 R |

*Primary Examiner*—James R. Scott

[57] ABSTRACT

An electrical timer-switch has a clock motor which closes and opens a switch, the two contact points of the switch being wired to external contacts which can be plugged into a wall switch receptacle to establish a shunt around the latter switch.

8 Claims, 16 Drawing Figures

ELECTRICAL TIMER-SWITCH

This application is a continuation-in-part of my application Ser. No. 475,741 filed on June 3, 1974 now abandoned, which was a division of my original application Ser. No. 337,831 filed on Mar. 5, 1973 which is now U.S. Pat. No. 3,828,224.

This invention relates to electrical timer-switches which are especially adapted for use in the system and receptacles disclosed and claimed in said original application which is now U.S. Pat. No. 3,828,224. They may be used as well in the systems and devices of my patent application Ser. No. 493,414 filed on July 31, 1974 and in my patent application Ser. No. 573,833 filed on May 2, 1975. Some of them may be used in the ordinary conventional household electrical circuit. The disclosures of my patent and pending applications are to be considered as incorporated herein by this reference.

There is now available a timer-switch which has prongs that directly plug into a wall receptacle or has an extension cord that is to be plugged into a wall receptacle. In this way, it receives electricity to run an enclosed clock and operate an enclosed switch which can be pre-set for a timed on-and-off interval. This switch is connected to an outlet receptacle which is a part of the timer casing or it is connected to an electrical wire which terminates in a socket into which a floor light, for example, may be plugged.

These past timer-switch units have lacked the versatility of application which many persons have wanted. For instance, many persons have wished that they had a set-up which would make it possible to turn on and off an outside light at preset times. The present day, permanent wiring in a house, makes it impossible to insert a timer in its outside light circuit unless an extensive and expensive rewiring job is done. Or, an unattractive permanent unit is mounted in the wall box. This is true, also, of ceiling lights as they are always permanently wired to a wall switch and to cut into the circuit to insert a timer would involve a radical and expensive wiring rearrangement.

The timer-switches of the present invention involve the feature that when they are used in conjunction with the receptacles disclosed and claimed in my aforesaid patent and patent applications, they become portable timer-switches and can be plugged into any like one of them to selectively supply electricity to the wires leading out of the wall box. Those wires may go to ceiling lights, basement lights, outdoor lights, or wall receptacles for instance.

Figure 1:
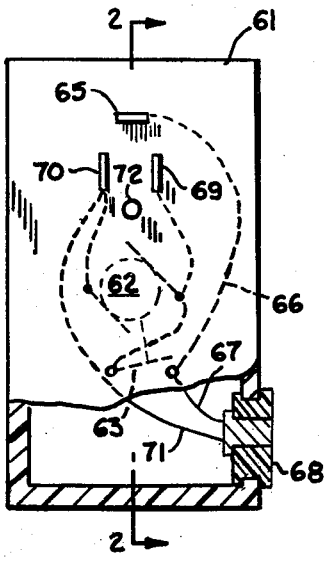
Figure 2:
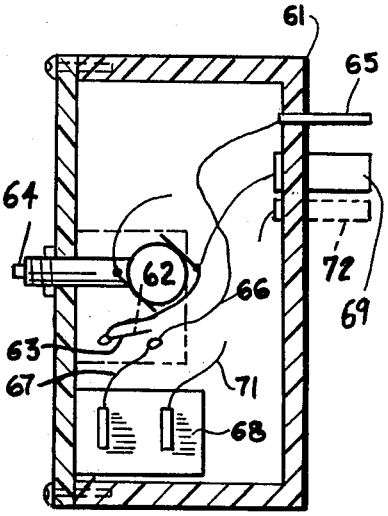
Figure 8:
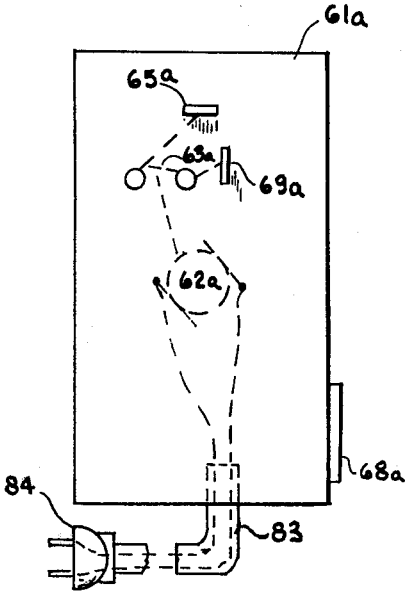
Figure 3:
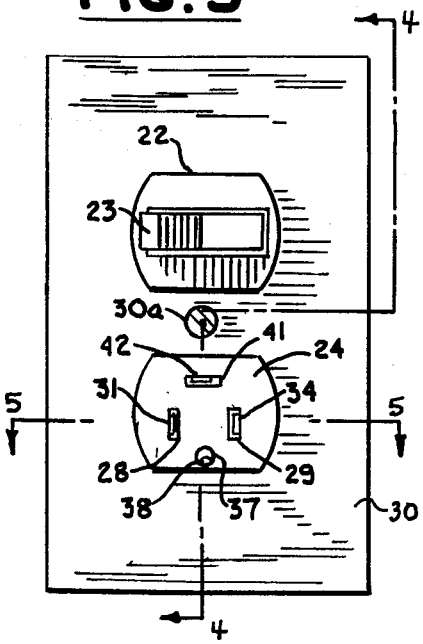
Figure 4:
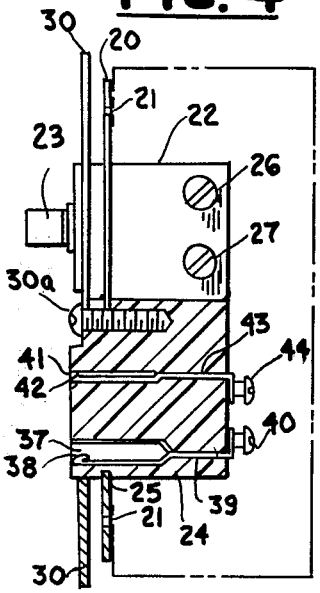
Figure 9:
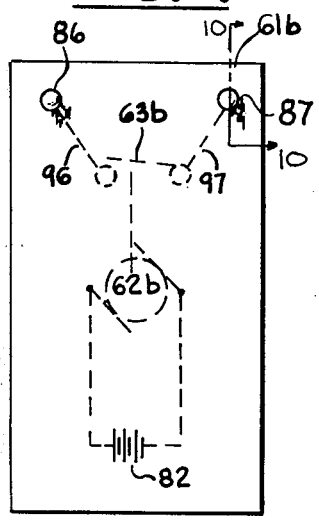
Figure 5:
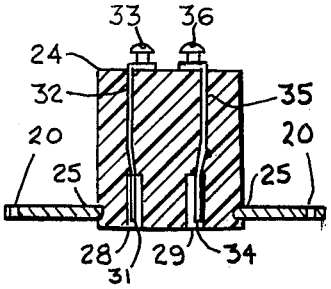
Figure 6:
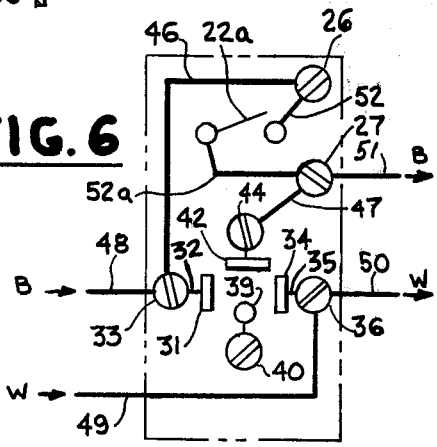
Figure 7:
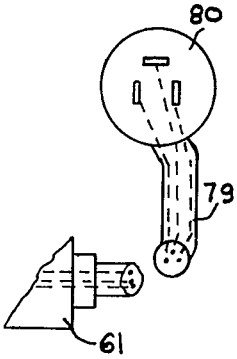
Figure 10:
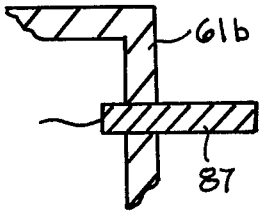
Figure 11:
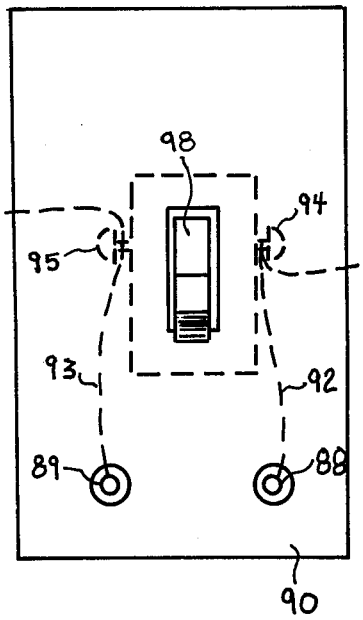
Figure 12:
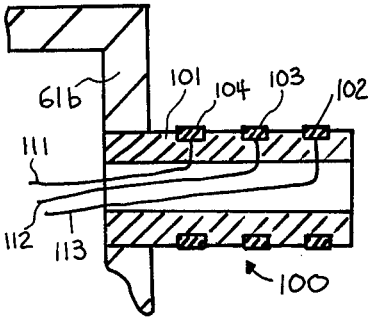
Figure 13:
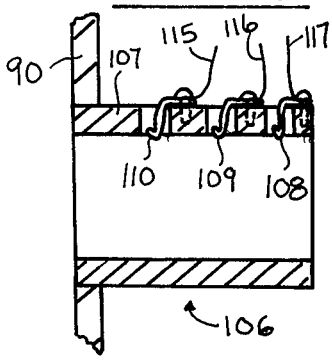
Figure 14:
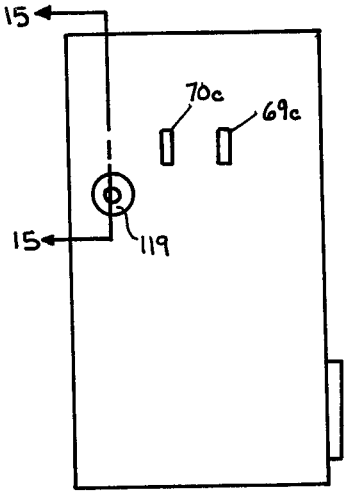
Figure 15:
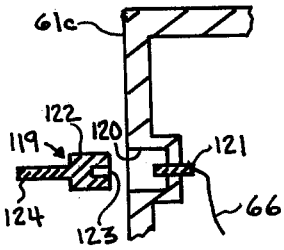
Figure 16:
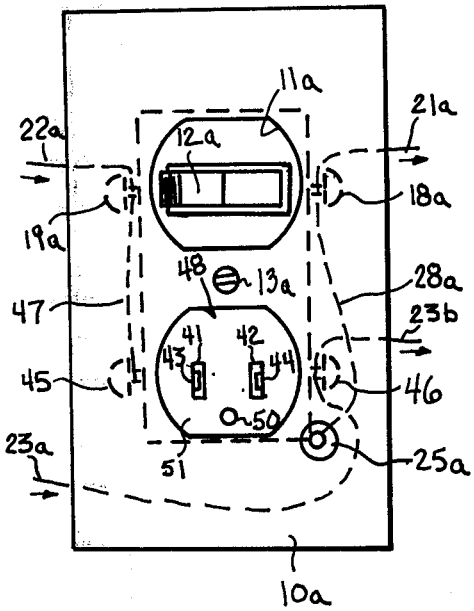

The invention will be clarified by reference to the drawings in which:

FIG. 1 is a rear view of a preferred form of the timer-switch, a lower portion being broken away to show the integral outlet receptacle, and internal elements being shown in symbolic form, FIG. 2 is a sectional view on the line 2—2 of FIG. 1, elements therein being shown in symbolic form, FIG. 3 is a front view of the combination switch and outlet receptacle unit and an attached cover plate, to which the timer-switch of FIGS. 1 and 2 is to be applied, FIG. 4 is a side view of FIG. 3 on the line 4—4 so that the upper portion is in elevation and the lower portion is in section, the outline of a conventional wall box being indicated in dotted lines, FIG. 5 is a cross-sectonal view on the line 5—5 of FIG. 3, the cover plate being omitted, FIG. 6 is a schematic wiring diagram showing how the combination switch and wall receptacle unit is connected into a home circuit, FIG. 7 is a detailed view of an alternate wiring for the timer-switch of FIGS. 1 and 2, FIG. 8 is a rear view of a timer-switch which is similar to FIG. 1, but has a modified wiring supply, FIG. 9 is a rear view of a timer-switch which has a self-contained battery to drive the motor and has a modified external prong structure, FIG. 10 is a fragmentary sectional view on the line 10—10 of FIG. 9, FIG. 11 is a front view of a wall switch and cover plate assembly having jacks to receive the external prongs of FIGS. 9 and 10, FIG. 12 is a longitudinal sectional view of a three wire circuit plug or prong, FIG. 13 is a longitudinal sectional view of a jack to be used with the plug of FIG. 12, FIG. 14 is a rear view of a timer-switch to which a third, removable prong has been added, FIG. 15 is a sectional view on the line 15—15 of FIG. 14, with the removable prong displaced, and FIG. 16 is a front view of a switch and outlet receptacle similar to FIG. 3 but showing a modification to receive the timer-switch of FIGS. 14 and 15.

Referring first to FIGS. 1 and 2, the invention contemplates the use of a conventional timer box or casing 61 having two prongs 69 and 70, i.e., a pair, (and a possible third prong to make a grounding connection) to enter the two slots in a standard outlet receptacle. As this timer box and its internal parts are standard articles, its elements are only shown symbolically or schematically in FIGS. 1 and 2. Generally considered, it includes a synchronous clock motor 62 which operates a switch 63. The motor mechanism includes a stem 64 which projects out of the timer box so that the clock can be set to the correct time and the moments to turn on and turn off the switch 63 can be preset. As there is no present novelty in this mechanism, only a generalized illustration of it is made here.

One feature of the invention involves adding to the back wall of the casing 61, a horizontal prong 65 which is intended to enter the slot 41 of the receptacle shown in FIGS. 3 and 4, for the purpose to be explained. This prong 65 is connected to one side of the switch 63 by wire 66 so that it receives electrical energy through the switch from the (black wire side) prong 69. Another lead 67 is connected from this same side of the switch to one of the outlet slots of the usual outlet 68 which is a part of the timer switch. Consequently, when the switch 63 is closed, electricity is supplied from prong 69 to both the horizontal prong 65 and to the contact means in one of the outlet slots in the outlet 68.

The prong 69 is also wired to the motor 62. The other prong 70 (the white wire connection) is wired to the motor 62 to make it function and by wire 71 to the other slot of outlet 68; this connection is not fully shown in FIG. 2 because of the sectional view, but it is a conventional connection.

The timer of FIGS. 1 and 2 is to be plugged into the outlet receptacle of FIGS. 3 to 6 and the prongs 69 and 70 will enter the slots 28 and 29 respectively and will receive energy to operate the clock mechanism as will be explained. When the clock mechanism closes the switch 63, electricity will be supplied to the outlet 68 in a normal manner and electricity will also be supplied to prong 65. From prong 65, electricity flows to contact means 42 in receptacle slot 41 and then through wire 51, FIG. 6, to the ceiling light, porch light, outdoor light, or whatever wire 51 (and wire 50) is connected to. This functioning will be clarified by the following description of the system and structures of FIGS. 3 to 6 inclusive.

Referring first to FIG. 4, the metal plate 20 is of the usual conformation of switch plates or receptacle plates and it has the holes 21 therein to receive screws (not shown) for attaching the plate to a conventional wall box (shown in dotted lines in FIG. 4). Firmly attached to the upper portion of plate 20 is a conventional switch block 22, the internal switch being manually moved to off and on positions by the finger piece 23. Firmly attached to the lower portion of plate 20 is an outlet receptacle block 24 which embodies the invention of my patent. A cover plate 30 will be fastened to the block 24 (or block 22 if preferred) by screw 30*a*.

The switch block 22 has two screw terminals 26 and 27 on its side for connection to wires in the usual manner. When the switch 22*a* within block 22 is in closed position, the terminals 26 and 27 are internally connected together to establish a closed circuit. See FIG. 6 for a schematic showing.

The outlet receptacle block 24 has the usual parallel, pair of spaced slots 28 and 29 therein. They are spaced and shaped to receive the usual pair of power prongs of a plug which, for example, leads to a radio, floor light, or small utility article. To establish an electrical connection in slot 28 a spring leaf 31 is located therein, and it is connected by the conductor lead 32 to a screw terminal 33 on the rear of the block 24. In like manner, to establish an electrical connection in slot 29 a spring leaf 34 is located therein, and it is connected by the conductor lead 35 to a screw terminal 36 on the rear of block 24.

The block 24 is shown as having the round slot 37 therein to establish a ground connection. It has a leaf spring 38 therein connected by a lead 39 to the external screw terminal 40. This grounding slot 37 and its electrical connections may be entirely eliminated if this safety feature is to be disregarded.

The novel feature of the invention claimed in my patent is the provision of the horizontal slot 41, see FIGS. 3 and 4 hereof, which is asymmetrically positioned relative to slots 22 and 29 so that the plug prongs can enter in only one oriented position. As is disclosed in my patent, the slot 41 may otherwise be shaped or positioned so that the special prong 65 can enter only that particular slot 41.

Within the horizontal slot 41 is the leaf spring 42 mentioned above, to make an electrical connection with the prong 65 to be inserted in slot 41. The leaf 42 is connected by lead 43 to screw terminal 44.

A schematic of the wiring for this combination switch and outlet receptacle system is shown in FIG. 6. A symbolic representation of the switch within block 22 is indicated at 22*a* in FIG. 6. An insulated wire 46 is connected between terminals 26 and 33. An insulated wire 47 is connected between the terminals 27 and 44.

The black wire 48 from the power source is connected to screw terminal 33 (or to screw terminal 26 since they are connected by the lead 46). The white wire 49 from the power source is connected to the terminal 36. The white wire 50 going to the, e.g., ceiling or other light (not shown), is also connected to the terminal 36. The black wire 51 going to the same ceiling (or other) light is connected to screw terminal 27. It does not matter whether terminal 26 or 27 is connected to the internal moving element of the switch 22*a* within block 22; these internal wires within the switch block are shown at 52 and 52*a*.

At this point it should be noted that if an external connection is made between leaf springs 31 and 42 (see FIG. 6), there will be established an electrical connection between the lead-in black wire 48 and the outgoing black wire 51, as if the switch at 22*a* had been closed. The invention which is herein claimed includes timer-switches of novel designs which will establish such an external connection between leaf springs 31 and 42. If such an external connection is not made, the slot 41 and its leaf spring contact 42 is not used and does not interfere with the insertion of an ordinary plug in slots 28 and 29.

This same timer-switch unit may be plugged into any selected one of the combination switch-outlet units or systems of FIGS. 3 and 4, because of the universal applicability and portability of the timer-switch unit. Obviously, this feature of inserting the same timer-switch, in any selected outlet of FIGS. 3 and 4 located at various places in a house offers a considerable money saving over locating a separate timer-switch at every location. The outlet 68 may be used in the conventional manner to receive the plug of a floor light, radio, toaster, etc. The grounding plug 72 is shown in dotted lines as it may or may not be present.

An important feature of this invention, therefore, is that if every wall switch box in a house has in it the combination unit of FIGS. 3 and 4, the same portable timer-switch of FIGS. 1 and 2 can be plugged in the selected one to control the connected light. As has been mentioned above, the switch box may be connected by out-going wires 50 and 51 to a wall outlet (instead of a ceiling light) into which a floor light is to be plugged.

FIG. 7 shows a generalized representation of the use of a lead wire which make it possible to eliminate the prongs on the timer-switch of FIGS. 1 and 2. The box or casing of the timer-switch is indicated at 61 and from it leads a wire 79 to a plug assembly 80. The plug assembly 80 carries or supports a set of prongs spaced to enter the slots in block 24, and they are connected by wires within 79 to the appropriate elements within the box 61, as explained above.

The timer-switch of FIGS. 1 and 2 or its modifications as explained above such as the use of the connection cord of FIG. 7, may be plugged into any of the arrangements illustrated in FIGS. 12 to 16 inclusive of my patent, having in mind that the prongs must mate with the receiving slots. As is also pointed out in the patent, the timer switch may be used in commercial and industrial operations.

In the modification of FIG. 8 the electric motor 62*a* does not receive the electricity which drives it, from prongs such as 69 and 70 which supply electricity to the motor 62 in FIG. 1. Instead, the motor 62*a* receives its electric energy from the conductors in the wire 83 that terminates in the plug 84 which is of conventional structure and is commercially available. The external prongs 65*a* and 69*a* which are electrically connected together by the switch 63*a*, correspond to the elements 65, 59 and 63 in FIG. 1. The timer-switch of FIG. 8 can be plugged into the receptacle 24 of FIGS. 3 and 4 to shunt around the switch 22*a* in block 22. The plug 84 can be inserted in any favored outlet receptacle.

In the modification of FIG. 9, a low voltage battery 82 (e.g., 6 volts) is located within the casing 61*b* and it is wired to the low voltage motor 62*b* which functions as a clock motor to operate the switch 63*b*. This eliminates the need for the prongs 69 and 70 in FIG. 1, and the plug 84 in FIG. 8. As these prongs are not required to receive electricity for driving the house line voltage motor in FIGS. 1 and 8, the structure of FIG. 9 makes it possible to connect the two sides of the switch 63*b* to the special prongs 86 and 87 by the wires 96 and 97. FIG. 10 shows that prong 87 is embedded in and carried by the casing 61*b* and the other prong 86 is supported in like manner.

These prongs 86 and 87 are of a size and are spaced apart to enter the jacks 88 and 89 carried by the cover plate 90 of FIG. 11. These jacks 88 and 89 correspond respectively to the jacks 25 and 26 of the system and structure disclosed and claimed in my application Ser. No. 573,833. If the latter jacks 25 and 26 are appropriately located to receive the prongs 86 and 87, the manual switch is shunted. FIG. 11 hereof shows the wires 92 and 93 which connect the jacks 88 and 89 to the opposite pole contacts 94 and 95 of the manual switch 98.

One of the terminals 94 and 95 is connected to the black line voltage wire and the other terminal is connected to the black wire leading to a ceiling light, outdoor light or floor receptacle, for instance. Consequently, when the self-powered timer-switch of FIG. 9 is plugged into the jacks 88 and 89 of the assembly of FIG. 11, the closure of the switch 63*b* has the same effect as closing the switch 98, i.e., the switch 90 is shunted.

The prongs 86 and 87 may be the so-called banana plugs which are commercially obtainable, or they may be of other known types and the jacks 88 and 89 must, of course, be of a suitable receiving type. The use of such special prongs makes the user aware of the fact that they are not to be inserted in the conventional power slots shown at 28 and 29.

Instead of the single circuit prongs and jacks shown in FIGS. 9 and 11, the invention contemplates the use of conventional multi-circuit prongs and jacks such as are shown in FIGS. 12 and 13. The prong or plug 100 of FIG. 12 is a simplified illustration of a commercially obtainable plug of the kind used in audio or power equipment. It includes a tubing 101 of insulating material and, embedded therein as by a molding process, three spaced apart rings 102, 103 and 104. This assembly is cemented to or is otherwise carried by the casing 61*b*.

The plug 100 is to be inserted into the jack 106, shown in FIG. 13 as being attached to the inner face of the cover plate 90. It is made up of an insulating tubing 107 and three contact leaf springs 108, 109 and 110 attached thereto. These springs project through holes in tubing 107 and into the interior of this tubing. The free end of spring 108 is positioned to bear on the ring 102, the end of spring 109 is to bear on the ring 103 and the end of spring 110 is to bear on the ring 104. Thus the one plug 100 and the one jack 106 serve the purpose of three single circuit plugs and jacks.

The wire 111 to the ring 104 corresponds to wire 96 in FIG. 9, the wire 112 connected to ring 103 corresponds to wire 97 in FIG. 9 and the wire 113 connected to the ring 102 corresponds to the white line voltage wire as will be explained. The spring 110 is connected to a wire 115 corresponding to wire 47 in FIG. 6, spring 109 is connected to a wire 116 corresponding to wire 32 and spring 108 is connected to a wire 117 which corresponds to wire 35.

It will be noted, therefore, that ring 104 corresponds to prong 86 and that ring 103 corresponds to prong 87 in FIG. 9. Or, looking at FIG. 1, the ring 104 corresponds to prong 65 and the ring 103 corresponds to prong 69. The ring 102, furthest out on tubing 101, corresponds to prong 70 in FIG. 1 which makes contact with the white line voltage wire.

The ring 102 and its wire 113, can be eliminated along with the spring 108 and its wire 117 if the systems of FIGS. 8 and 9 are used. This is because the power suply which requires the prong 70 and the contact 34, is not utilized.

FIGS. 14 and 15 show that a conventional timer-switch can be equipped with a removable prong 119 which replaces the fixed prong 65 of FIG. 1. The two prongs 69*c* and 70*c* are the standard ones that are on the back wall of commercial timer-switches 61*c*. This back wall is formed with a socket 120 into which a metal stud or pin 121 partially projects. Pin 121 is firmly held by casing wall 61*c* and the wire 66 of FIG. 1 is connected to this pin 121. The removable prong 119 is made of metal and it has an enlarged base 122 which frictionally fits in the socket 120 but it may be screw threaded in the socket 120. This base 122 has a recess or bore 123 therein to receive and make electrical contact with the pin 121. Projecting oppositely from the base 122 is a prong 124 which serves the function of prong 65 in FIG. 1.

This prong 124 is so located that it will enter the jack 25*a* fastened to the cover plate 10*a* in FIG. 16. It should be noted that the structure of this FIG. 16 is the same as the structure of FIGS. 5, 6 and 7 of my copending application Ser. No. 573,833; for this reason the same reference numerals are used. As is stated in Ser. No. 573,833, the two prongs 69*c* and 70*c* enter the slots 41 and 42. If the removable plug 119 is in place in the socket 120, its prong 124 enters the jack 25*a* and makes electrical contact.

If the removable plug 119 is taken out of its socket 120, the timer-switch of FIGS. 14 and 15 can be inserted in a conventional receptacle outlet that does not have the jack 25*a*.

It has been stated above that the receptacle structure of FIG. 16 hereof is the same as that of FIGS. 5, 6 and 7 of application Ser. No. 573,833 and that the timer-switch of FIG. 13 hereof is adapted to be used with that receptacle structure. It should also be noted that the switch and jack structure of FIG. 11 hereof corresponds to the switch and jack structure of FIG. 3 of my application Ser. No. 493,414. Thus, the jacks 88 and 89 on the cover plate 90 in FIG. 11 hereof correspond to the jacks 27′ and 23′ in the switch block 18 of FIG. 3 of Ser. No. 493,414. Because of this, the timer-switch of FIG. 9 hereof can be applied to the block 18 of FIG. 3 of Ser. No. 493,414 as readily as it may be applied to the structure of FIG. 11 hereof.

Another alternative to which this invention lends itself is the replacement of the prongs 65*a* and 69*a* in FIG. 8 hereof with prongs such as and located as the prongs 86 and 87 of FIG. 9 hereof. If the plug 84 is then inserted in a standard outlet receptacle so that the motor 62*a* is driven, the timer-switch of FIG. 8, with it's modified prongs, can be plugged into the system of FIG. 3 of Ser. No. 493,414. Other adaptations are contemplated, such as the replacement of the prongs 86 and 87 of FIG. 9 hereof, with the prongs 65*a* and 69*a* in their location of FIG. 8 hereof. This timer-switch could be applied to the receptacle of FIG. 3 hereof, as well as to the receptacles of FIGS. 1 and 2 of Ser. No. 493,414.

The timer-switches disclosed herein have as a common feature the fact that the external prongs which are connected to the internal switch contacts, cannot be inserted in the conventional slots 28 and 29 of the standard outlet receptacle. For instance, the prongs 65 and 69 cannot be inserted in the slots 28 and 29 because of the spacing of the prongs 28 and 29, because of their relative configuration and because they form an asymmetrical relationship with the prong 70. The prongs 86 and 87 of FIG. 9 are spaced differently from the slots 28 and 29 or are shaped so they cannot enter the slots. Obviously, the multi circuit plug of FIG. 12 with its contact rings cannot enter the slot 28 or 29.

In all of the timers of this invention, there are external contacts which are wired to the opposite poles or sides of the internal switch which is moved to an on and off position by a clock motor. The clock motor may be driven by batteries which are located in the casing or the motor may be driven by house line voltage which is delivered to the motor by means of external prongs or plugs. In the latter case, a single external prong, i.e. 69, may deliver line voltage to both the clock motor and to one side of the internal switch. FIG. 8 shows that the clock motor may have its own distinct supply of house line voltage. In FIG. 9 the electric motor 62*b* and battery 82 are replaceable with a spring driven clock motor.

I claim:

1. A timer-switch comprising an enclosing casing; an electrical switch supported therein having two electric switch contacts and a movable electricity conducting element for electrically connecting and disconnecting said switch contacts; a clock motor also supported within the casing; mechanical connecting means from the clock motor to said movable conducting element to operate it at a predetermined interval and thereby electrically connect and disconnect said switch contacts; a first prong and a second prong supported by the casing and constituting a pair of conventionally disposed prongs projecting from the casing for entry in a conventional wall electrical outlet; a third prong supported by the casing and projecting in an unconventional position outside of said pair of prongs; a wire connecting said third prong to one of said switch contacts and another wire connecting the other switch contact to said first prong, whereby closure of said switch by said movable element electrically connects said third prong to said first prong.

2. The timer-switch according to claim 1 in which said clock motor is electrically driven and receives its energy by wires leading to it from said pair of conventionally disposed prongs.

3. The timer-switch according to claim 1 in which said third prong is removably mounted in the casing, whereby its removal permits entry of said conventional prongs into a conventional wall outlet.

4. A timer-switch comprising an enclosing casing; an electrical switch supported therein having two electric switch contacts and a movable electricity conducting element for electrically connecting and disconnecting said switch contacts; a clock motor also supported within the casing; mechanical connecting means from the clock motor to said movable conducting element to operate it at a predetermined interval and thereby electrically connect and disconnect said switch contacts; two electrical contact elements carried by the casing and projecting exteriorly from the casing; a wire connecting one of said contact elements to one of said switch contacts and another wire connecting the other contact element to the other one of said switch contacts, whereby closure of said switch by said movable element electrically connects the two contact elements together.

5. The timer-switch according to claim 4 in which said clock motor is electrically driven and receives its energy by wires leading to it from a battery disposed within said casing.

6. The timer-switch according to claim 4 in which said clock motor is electrically driven and receives its energy by wires leading from it to a cable which is outside of the casing and which terminates in a conventional two-prong plug.

7. The timer-switch according to claim 4 in which said contact elements are carried by a single prong which also insulates them from each other.

8. The timer-switch according to claim 4 in which said contact elements are separate prongs.

* * * * *